United States Patent [19]

Friddle, Sr. et al.

[11] 4,117,753

[45] Oct. 3, 1978

[54] SHEET CUTTING APPARATUS

[76] Inventors: William D. Friddle, Sr., Covington Rd., Greenville, S.C. 29609; William D. Friddle, Jr., Eastcliff Way; Wilbourne D. O'Steen, 44 Smythe Ave. Dunean, both of Greenville, S.C. 29611

[21] Appl. No.: 674,373

[22] Filed: Apr. 7, 1976

[51] Int. Cl.[2] ..... B26D 5/08; B26D 7/06

[52] U.S. Cl. ..... 83/143; 83/397; 83/455; 83/590; 83/614

[58] Field of Search ..... 83/455, 590, 614, 485, 83/143, 381, 397, 398, 466.1, 588, 922, 649, 650; 53/390

[56] References Cited

U.S. PATENT DOCUMENTS

| | | | |
|---|---|---|---|
| 943,221 | 12/1909 | Engberg | 83/614 X |
| 976,949 | 11/1910 | Tucker | 83/614 X |
| 2,013,894 | 9/1935 | Olsen | 83/614 X |
| 2,265,498 | 12/1941 | Stancliff et al. | 83/614 X |
| 2,310,838 | 2/1943 | Helprin | 83/588 X |
| 3,017,795 | 1/1962 | Joa | 83/143 X |
| 3,072,000 | 1/1963 | Bracey et al. | 83/649 X |
| 3,088,355 | 5/1963 | Hornzostel, Jr. | 83/614 X |
| 3,135,077 | 6/1964 | Siegel et al. | 53/182 R |
| 3,156,391 | 11/1964 | Wicksall | 83/649 X |
| 3,442,064 | 5/1969 | Conti | 53/390 |
| 3,452,511 | 7/1969 | Hoffler | 53/390 X |
| 3,621,748 | 11/1971 | Felstehausen | 83/588 X |
| 3,641,854 | 2/1972 | Keesling | 83/455 X |
| 3,986,419 | 10/1976 | Cleghorn | 83/478 X |

FOREIGN PATENT DOCUMENTS

| | | | |
|---|---|---|---|
| 664,437 | 6/1963 | Canada | 83/649 |

*Primary Examiner*—John Sipos

*Attorney, Agent, or Firm*—Bailey, Dority & Flint

[57] ABSTRACT

A sheet cutting apparatus is illustrated as including a free standing cutting blade movable across the sheet material. A base member has a longitudinal channel therein through which the knife extends into a complimentary channel carried by a pressure bar so that the sheet material is confined between the base and the pressure bar for cutting by the blade which is contained safely within the base and pressure bar during its cutting stroke across the sheet material. A lifter bar is positioned adjacent the base member for raising the severed end of sheet material of the dispensing roll preparatory to cutting off another length of sheet material.

3 Claims, 4 Drawing Figures

SHEET CUTTING APPARATUS

BACKGROUND OF THE INVENTION

Sheet cutting devices of a wide variety have been provided by the prior art usually being especially adapted to sever a particular sheet material for a special purpose. U.S. Pat. No. 3,788,175 is exemplary of the prior art in that a base member having an open channel therein is provided for receiving a blade extending downwardly therein for movement across a sheet of non-woven material. A pressure bar engages the sheet material between the roll and the cutting channel. U.S. Pat. No. 3,745,863 illustrates a chain carried blade for cutting strips of sheet material such as paper. It has been found that devices constructed in accordance with the prior art are of limited effectiveness in positioning sheet material which is difficult to sever. For example, it is desired to provide a cutting apparatus for severing lengths of a highly waxed scrim material used in wrapping various large cuts of meat for shipment in boxes to the meat departments of grocery stores and supper markets. Savings have resulted in meat processing as a result of cutting the meat at the plant for delivery to the local butcher. Such cuts of meat have been wrapped in film which is heat shrunk. The bony areas, however, sever the wrap as a result of frictional engagement with the shipping container. The heavily waxed scrim sheet material is used to wrap over the bony areas to prevent the bones from cutting through and exposing the packaged meat.

While the invention is described in the context of the heavily waxed scrim sheet material, it is to be understood that many other types and qualities of sheet material may be advantageously cut using the apparatus constructed in accordance with the present invention.

It is an important object of the present invention to provide a cutting apparatus capable of positively positioning a sheet for a rapid and safe cutting action.

Another important object of the invention is to provide an inexpensive but effective apparatus for cutting sheets of material which are difficult to cut, such as a heavily waxed scrim material.

BRIEF DESCRIPTION OF THE INVENTION

It has been found that an improved sheet cutting apparatus may be provided by utilizing a suitable blade carrier mounting an upstanding blade thereon which extends through an open channel in a base member extending across a sheet which is to be severed and providing a complimentary channel in a pressure bar and the like which serves as a safety guard for containing the blade, as well as a means for positioning the sheet material for advantageous cutting.

The pressure bar also serves to actuate power operated means which includes a reel of metallic tape and the like, which serves as a blade carrier driven on the cutting stroke, the blade being withdrawn as by actuation of the reel. A lifting bar is provided which is also depressed by the action of the pressure bar but which is spring biased upwardly for raising the severed end of the sheet material preparatory to drawing off another length of sheet material.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
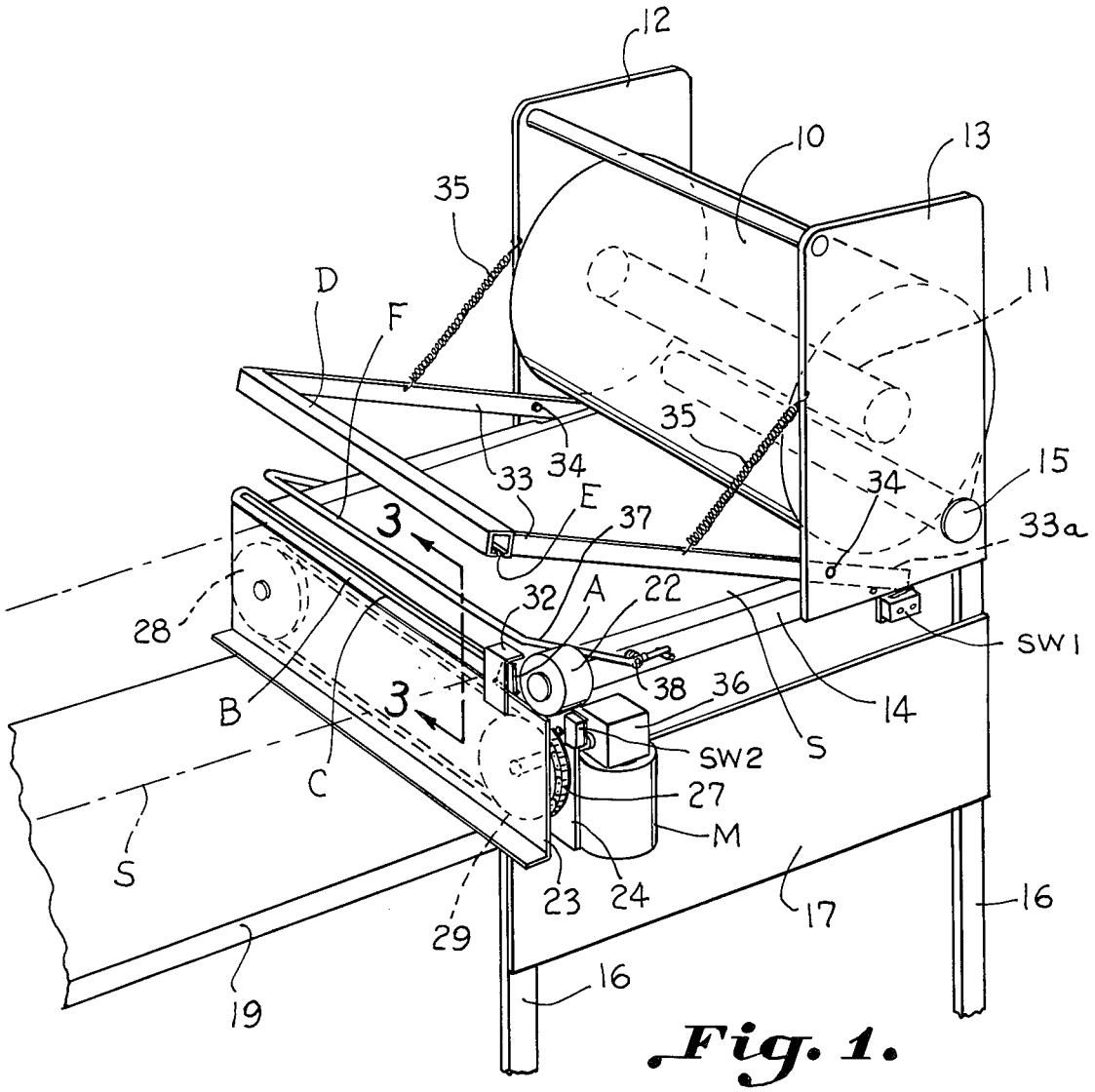
FIG. 1 is a perspective view illustrating a sheet cutting apparatus in accordance with the present invention with the pressure bar in raised position for withdrawing a length of sheet material from the dispensing roll.

The drawings illustrate a cutting apparatus for severing a length of sheet material from a roll dispensing sheet material. A free standing cutting blade A is movable across the sheet material for severing the sheet material. A base member B is positioned beneath extending across the sheet material. A first open elongated channel C is disposed in the base member through the cutting blade extends into severing relation to the sheet material. A pressure bar D is carried above the sheet material movable downwardly into holding engagement therewith opposite said base member during severing movement of the cutting blade across the sheet material. A second channel E is disposed in the pressure bar opening opposite the first channel and in alignment therewith for receiving and shielding a free end of the cutting blade therein during severing movement of the cutting blade across the sheet material so that the pressure bar containing the second channel serves also as a guard for said cutting blade. A lifting bar F is spring biased upwardly over which the sheet material passes from the roll to the cutting blade, depressed during severing movement of the cutting blade, and raised thereafter to lift a severed end of sheet material to facilitate further dispensing of sheet material from the roll.

The cutting apparatus includes a roll 10 for dispensing sheet material S. The roll 10 is carried upon a suitable roller 11 which is journaled in the upstanding support members 12 and 13 carried by a rectangular frame 14. Preferably, the roller 11 is provided with a frictional drag to prevent free wheeling of the roll 10 over the sheet material as the sheet material S passes the bar 15 for delivery in horizontal open width to the cutting mechanism thereof. The rectangular frame is carried by a suitable support having legs 16 provided with braces 17 from which extends a cutting table 19.

Figure 2:
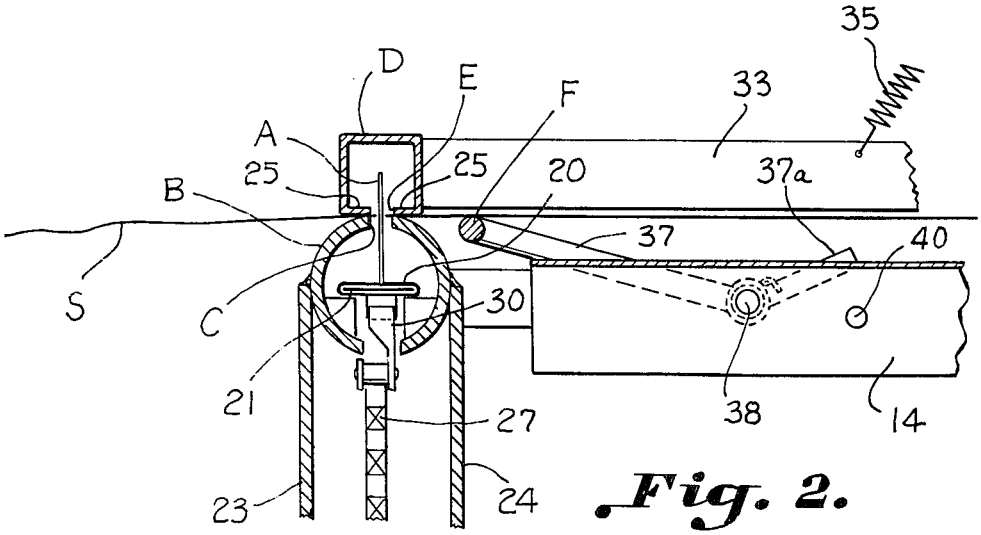
FIG. 2 is an enlarged sectional elevation illustrating the base member, pressure bar and associated parts in position carrying out a cutting action.
Figure 3:
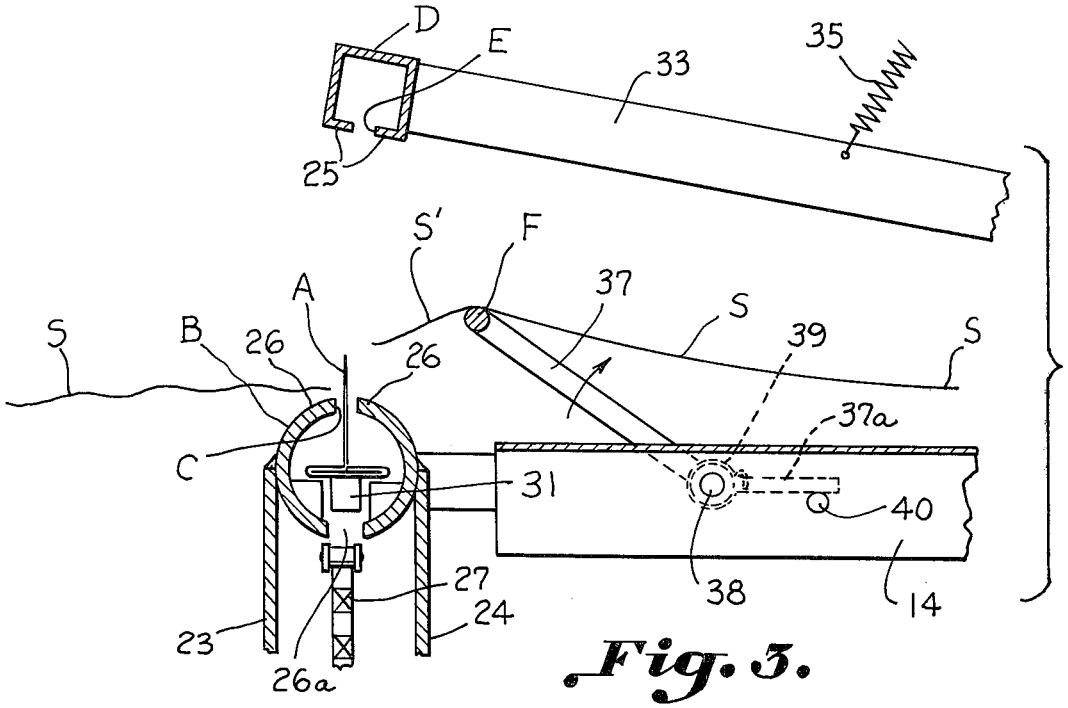
FIG. 3 is a longitudinal sectional elevation similar to FIG. 2 taken on the line 3—3 in FIG. 1, with the pressure bar in raised position and the cutting blade returned following a cutting operation wherein the knife is positioned within a shield which has been omitted for clarity of illustration.

The free standing blade A has a suitable mounting bracket 20 integral therewith for being replacable positioned on a blade carrier which constitutes a part of the power operated means for actuating the blade on a cutting stroke. The bracket 20 is illustrated in FIGS. 2 and 3 as being press fitted upon an end 21 of tape which is wound upon the tape reel 22. The tape reel 22 is of the type which permits positive withdrawal of the tape from the reel with an automatic takeup thereof upon release of the tape which has been withdrawn.

It will be noted that the base member B is constituted by a tubular member having an open elongated longitudinal channel C therein through which the blade A extends. The tubular base member B is welded adjacent opposed sides between a pair of vertical transverse support plates 23 and 24 fixed across the front of the frame member 14 for carrying the base plate and associated power operated mechanism. The pressure bar D is illustrated as a tubular member of substantially rectangular cross-section having lower inturned legs 25 which define the second channel E therebetween. The free ends of the inwardly extending legs 25 constitute shoulders which oppose shoulder members 26 (FIG. 3), which define the first channel C. The sheet material S is confined firmly between these shoulders 25 and 26 which exert a positive gripping force thereon facilitating the cutting action of the blade.

Figure 4:
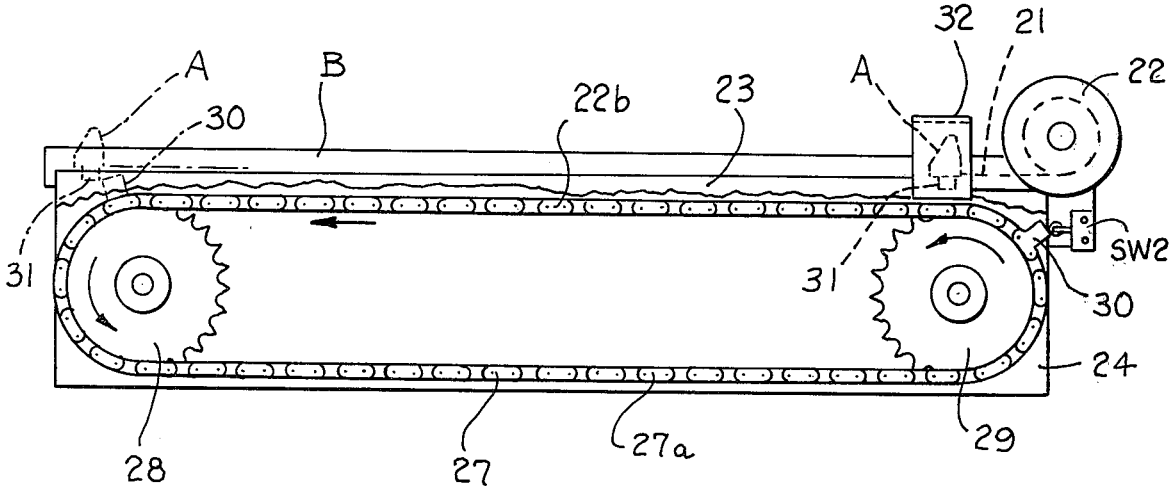
FIG. 4 is a front elevation illustrating a power operated mechanism showing the cutting blade on a cutting stroke thereof.

The power operated means for actuating and moving the blade includes a driven chain 27 carried upon suitable sprocket means 28 and 29 to provide a lower run 27*a* and an upper run 27*b*. The chain is driven in the direction of the arrow in FIG. 4 to engage a driving lug 30, extending upwardly through the opening 26*a* (FIG. 3), with a depending lug 31 on the blade carrier for moving the blade withdrawing the tape 21 on a power switching stroke in the direction of the arrow in FIG. 4. A shield 32 is carried by the support plates 23 and 24 for shielding the blade when it is in stopped position preparatory to a cutting stroke.

It will be observed that the pressure bar D is carried by a pair of arms 33 pivoted intermediate their ends as at 34 upon the vertical frame members 12 and 13. Springs 35 are provided to afford an upward bias to the pressure bar D. The pivoted arms 33 have a free end illustrated in FIG. 1 at 33*a* for engaging a switch SW1 for actuating the power operated mechanism.

When the pressure bar D is depressed the normally open switch SW1 is closed actuating a suitable starter relay (not shown) which starts the motor M. The motor M has a suitable power take off means 36 for driving the chain sprocket 39. The motor continues to run until the driving lug 30 engages the limit switch SW2 which actuates a second relay (not shown) and at the same time releases the first mentioned relay which stops the motor. The motor will remain stopped until the pressure bar is released and switch SW1 opened. Another cycle may then be commenced by depressing the pressure bar. Any suitable, preferably low energy, circuitry may be employed, but it is important that the cutting action be initiated by depressing the blade guard pressure bar and that such action not be resumed until the bar is raised to reset the mechanism.

The lifting bar F is inclined forwardly carried by suitable end linkage members 37 upon a transverse shaft 38 which has pivotal mounting in the frame member 14. The shaft carries a coil spring 39 which provides an upward bias for the lifter bar in the direction of the arrow in FIG. 3. A projection 37*a* extends inwardly engaging a stop 40 limiting upward movement of the bar F.

When the pressure bar D is manually operated switch SW1 is actuated and the pivoted arms 33 engage the lifter bar F adjacent to its ends to depress the lifter bar to the position shown in FIG. 2. After the severing operation is complete, the lifter bar raises the sheet material positioning the free end illustrated at S' in FIG. 3 preparatory to another dispensing and cutting operation.

While a preferred embodiment of the invention has been described using specific terms, such description is for illustrative purposes only, and it is to be understood that changes and variations may be made without departing from the spirit or scope of the following claims.

What is claimed is:

1. A cutting apparatus for severing a length of sheet material from a roll dispensing sheet material comprising:

a free standing cutting blade movable across said sheet material for severing the sheet material;

a base member beneath and extending across said sheet material;

a first open elongated channel in said base member through which said cutting blade extends into severing relation to the sheet material;

a pressure bar carried above said sheet material movable downwardly into holding engagement with said base member adjacent said open channel during severing movement of said cutting blade across said sheet material;

a second channel in said pressure bar opening opposite said first channel and in alignment therewith for receiving and shielding a free end of said cutting blade therein during severing movement of said cutting blade across said sheet material so that said pressure bar containing said second channel serves also as a guard for said cutting blade;

a spring biased pivoted arm depressible for carrying said pressure bar for arcuate movement into said holding engagement; and a lifting bar spring biased upwardly over which said sheet material passes from said roll to said cutting blade, depressed by engagement with said spring biased pivoted arm during downward movement of said pressure bar and during severing movement of said cutting blade, and raised thereafter upon raising of the pressure bar and release thereby to lift a severed end of sheet material to facilitate further dispensing of sheet material from said roll.

2. A lifting device for use in a cutting apparatus having a depressible and releasable pressure bar, and cutting means for severing a length of sheet material from a roll dispensing sheet material comprising:

a lifting bar extending transversely across said sheet material passing thereover between said roll and said cutting means for positioning a cut edge of sheet material after a cutting operation for manually pulling thereon for advancing the sheet material preparatory to another cutting operation; and a pivoted arm having an upward spring bias carrying said lifting bar, depressed by direct engagement by said pressure bar when depressed and raised following release of said pressure bar responsive to said upward spring bias, to lift a severed end of sheet material to facilitate manual dispensing of sheet material from said roll.

3. A cutting apparatus for severing a length of sheet material from a roll dispensing sheet material comprising:

a free standing cutting blade movable across said sheet material for severing the sheet material;

a metallic tape reel to which said blade is attached adjacent a free end of tape in alignment therewith;

a driven lug separate from said tape carried for transverse movement in pulling engagement with said tape preparatory to separation of the lug from said tape permitting return of the tape and blade carried thereby;

a driven chain havng spaced transverse runs, one run carrying the lug in said engagement and the other run returning the lug preparatory to another severing movement of said cutting blade; and separate means returning said tape preparatory to another severing movement of said cutting blade.

* * * * *